US008644442B2

(12) United States Patent
Gahl et al.

(10) Patent No.: US 8,644,442 B2
(45) Date of Patent: Feb. 4, 2014

(54) RADIOISOTOPE PRODUCTION AND TREATMENT OF SOLUTION OF TARGET MATERIAL

(75) Inventors: John M. Gahl, Columbia, MO (US); Michael A. Flagg, Columbia, MO (US)

(73) Assignee: The Curators of the University of Missouri, Columbia, MO (US)

( * ) Notice: Subject to any disclaimer, the term of this patent is extended or adjusted under 35 U.S.C. 154(b) by 6619 days.

(21) Appl. No.: 12/364,942

(22) Filed: Feb. 3, 2009

(65) Prior Publication Data

US 2009/0196390 A1 Aug. 6, 2009

Related U.S. Application Data

(60) Provisional application No. 61/063,623, filed on Feb. 5, 2008.

(51) Int. Cl.
*G21G 1/12* (2006.01)
*G21G 1/08* (2006.01)

(52) U.S. Cl.
USPC ..... 376/170; 376/158; 588/20

(58) Field of Classification Search
None
See application file for complete search history.

(56) References Cited

U.S. PATENT DOCUMENTS

| | | | | |
|---|---|---|---|---|
| 2,253,035 A | | 8/1941 | Hartmut | |
| 2,994,651 A | * | 8/1961 | Spence | 376/300 |
| 3,050,454 A | | 8/1962 | Barr et al. | |
| 3,205,016 A | | 9/1965 | Panning | |
| 3,573,165 A | | 3/1971 | Pinajian | |
| 3,676,675 A | | 7/1972 | Ransohoff et al. | |
| 3,778,627 A | | 12/1973 | Carpenter | |
| 3,786,258 A | | 1/1974 | Schmidt | |
| 3,799,883 A | | 3/1974 | Arino et al. | |
| 3,914,373 A | * | 10/1975 | Jepson | 423/2 |
| 3,950,017 A | | 4/1976 | Beurer | |
| 4,093,854 A | | 6/1978 | Turcotte et al. | |
| 4,158,700 A | | 6/1979 | Karageozian | |
| 4,180,476 A | * | 12/1979 | Anav et al. | 252/636 |

(Continued)

FOREIGN PATENT DOCUMENTS

| | | |
|---|---|---|
| FR | 2263511 | 10/1975 |
| JP | S53-030598 | 8/1978 |

(Continued)

OTHER PUBLICATIONS

Rahn et al., "A Guide to Nuclear Power Technology", Krieger et al, Malabar, Florida (USA), reprinted edition 1992, p. 452.*

(Continued)

*Primary Examiner* — Johannes P Mondt
(74) *Attorney, Agent, or Firm* — Greer, Burns & Crain Ltd.

(57) ABSTRACT

The invention provides methods for the production of radioisotopes or for the treatment of nuclear waste. In methods of the invention, a solution of heavy water and target material including fissile material present in subcritical amounts is provided in a shielded irradiation vessel. Bremsstrahlung photons are introduced into the solution, and have an energy sufficient to generate photoneutrons by interacting with the nucleus of the deuterons present in the heavy water and the resulting photoneutrons in turn cause fission of the fissile material. The bremsstrahlung photons can be generated with an electron beam and an x-ray converter. Devices of the invention can be small and generate radioisotopes on site, such as at medical facilities and industrial facilities. Solution can be recycled for continued use after recovery of products.

20 Claims, 4 Drawing Sheets

(56) References Cited

U.S. PATENT DOCUMENTS

| | | | | |
|---|---|---|---|---|
| 4,192,998 | A | 3/1980 | Azam | |
| 4,251,726 | A | 2/1981 | Alvarez | |
| 4,252,607 | A | 2/1981 | Thode | |
| 4,266,132 | A | 5/1981 | Marshall, III | |
| 4,310,765 | A | 1/1982 | Givens | |
| 4,311,912 | A | 1/1982 | Givens | |
| 4,397,810 | A | 8/1983 | Salisbury | |
| 4,666,651 | A | 5/1987 | Barjon et al. | |
| 4,713,581 | A | 12/1987 | Haimson | |
| 4,727,791 | A | 3/1988 | Satoh | |
| 5,280,505 | A | 1/1994 | Hughey et al. | |
| RE34,575 | E | 4/1994 | Klinkowstein et al. | |
| 5,392,319 | A | 2/1995 | Eggers | |
| 5,468,355 | A | 11/1995 | Shefer et al. | |
| 5,596,611 | A | 1/1997 | Ball | |
| 5,661,377 | A | 8/1997 | Mishin et al. | |
| 5,703,918 | A | 12/1997 | Hiismaki et al. | |
| 5,870,447 | A | 2/1999 | Powell et al. | |
| 5,903,622 | A * | 5/1999 | Yoon et al. | 376/156 |
| 5,910,971 | A | 6/1999 | Ponomarev-Stepnoy et al. | |
| 5,920,601 | A | 7/1999 | Nigg et al. | |
| 5,949,836 | A | 9/1999 | Lidsky et al. | |
| 5,962,597 | A * | 10/1999 | Ponomarev-Stepnoy et al. | 525/329.6 |
| 5,976,066 | A | 11/1999 | Yanch et al. | |
| 6,127,687 | A | 10/2000 | Williams et al. | |
| 6,208,704 | B1 * | 3/2001 | Lidsky et al. | 376/156 |
| 7,186,987 | B1 * | 3/2007 | Doty et al. | 250/390.01 |
| 2002/0034275 | A1 * | 3/2002 | Abalin et al. | 376/189 |
| 2006/0104401 | A1 | 5/2006 | Jongen et al. | |
| 2007/0160176 | A1 | 7/2007 | Wada | |

FOREIGN PATENT DOCUMENTS

| | | |
|---|---|---|
| JP | H10-508950 | 9/1998 |
| KR | 10-2005-0084202 | 8/2005 |
| WO | WO 02/090933 | 11/2012 |

OTHER PUBLICATIONS

The Penguin Dictionary of Physics 2011, Market House Books Ltd., retrieved from http://www.credoreference.com/pendphys/fissionable, "fissionable" (2009).*

Lakosi et al., "Phoneutron interrogation of low-enriched uranium induced by bremsstrahlung from a 4 MeV linac", Nuclear Instruments and Methods in Physics research B 266, pp. 295-300 (2008) (available online Nov. 19, 2007).*

Rahn et al., "A Guide to Nuclear Power Technology", Krieger Publishing Co., Malabar, FL (USA) (1992), p. 133.*

Archbutt et al., "Density of the Metallic Elements", *International Critical Tables of Numerical Data, Physics, Chemistry and Technology*, 2003, pp. 456-478.

L.A. Artsimovich, "Controlled Thermonuclear Reactions", Gordon and Breach Publishers, New York, 1st English Ed., 1964, pp. 1-9.

Bowman, C.D., "Efficient Neutron Production Using Low-Energy Electron Beams", Nuclear Science and Engineering: 75, pp. 12-15 (1980).

Brovtsyn et al., "Experimental investigation of a microtron as a neutron source for activation analysis", translated from Atomnaya Energiya, vol. 32, No. 5, pp. 383-388 (1972).

Chakhlov et al., "Photoneutron source on a compact 10 MeV betatron", Nuclear Instruments and Methods in Physics Research A, vol. 422, pp. 5-9 (1999).

Duckworth et al., "High-energy electron accelerators as pulsed neutron sources", Nature, No. 4153, p. 869 (1949).

Feld, B.T., "The linear electron accelerator as a pulsed neutron source", Nucleonics, vol. 9, No. 4, pp. 51-57 (1951).

Golovkov et al., "Measurement of the photoneutron flux density distribution from cylindrical targets", Translated from Soviet Physics Journal, vol. 32, No. 9, pp. 667-668 (1989).

Harker et al., "INEL and ISU BNCT research using a 2 MeV RFQ-based neutron source", Nuclear Instruments and Methods in Physics Research B., vol. 99, pp. 843-846 (1995).

Hunt, C.A., "Neutron radiography with a 5.5 MeV linear accelerator-beryllium source", British Journal of Non Destructive Testing, pp. 78-85, (1969).

Jallu et al., "Photoneutron production in tungsten, praseodymium, copper and beryllium by using high energy electron linear accelerator", Nuclear Instruments and Methods in Physics Research B., vol. 155, pp. 373-381 (1999).

Kase et al., "An assessment of the Continuous Neutron Source Using a Low-Energy Electron Accelerator", Nuclear Science and Engineering, vol. 126, pp. 59-70 (1997).

Kneeland, D.R., "Current Accelerators for Research and Industry", IEEE Transactions on Nuclear Science, vol. NS-28, No. 2 pp. 1452-1460 (1981).

Kovalev et al., "Isotropic neutron source using the LUE-25 linear electron accelerator", Translated from Atomnaya Energiya, vol. 32, No. 2, pp. 173-175 (1972).

Miley et al., "The IEC-A Plasma-target-Based Neutron Source", Applied Radiation and Isotopes, vol. 48, No. 10-12, pp. 1557-1561 (1997).

Moses et al., "Electron accelerator used for producing neutrons", Nucleonics, vol. 14, No. 9, pp. 118-119 (1956).

Ratcliff, B.J., "Development of a non-reactor neutron radiographic assembly using a 12 MeV linear electron accelerator", British Journal of Non Destructive Testing, pp. 94-98 (1988).

Swenson, D.A., "Compact, inexpensive, epithermal neutron source for BNCT", Applications of Accelerators in Research and Industry, CP475, pp. 1037-1040 (1999).

Vasina et al., "Photoneutron Yields from Targets of $^{2}H_2O$, Be, and $^{238}U$ Irradiation with Bremsstrahlung from 4-to 8-MeV Electrons", Translated from Atomnaya Energiya, vol. 66 No. 1, pp. 56-57 (1989).

Wang et al., "A neutronic study of an accelerator-based neutron irradiation facility for boron neutron capture therapy", Nuclear Technology, vol. 84, pp. 93-107 (1989).

Yanch et al., "Design of low-energy beams for boron neutron capture synovectomy", SPIE vol. 2867, pp. 31-40 (1997).

Yanch et al., "Research in boron neutron capture therapy at MIT LABA", Applications of Accelerators in Research and Industry, pp. 1281-1284 (1997).

Office Action dated Nov. 27, 2012 from Korean Application No. 10-2010-7019765, Nov. 27, 2012, John M. Gahl.

* cited by examiner

RADIOISOTOPE PRODUCTION AND TREATMENT OF SOLUTION OF TARGET MATERIAL

PRIORITY CLAIM AND REFERENCE TO RELATED APPLICATION

The application claims priority under 35 U.S.C. §119 from prior provisional application Ser. No. 61/063,623, which was filed Feb. 5, 2008.

FIELD

Fields of the invention include photoneutron and radioisotope generation. Example applications of the invention include production of photoneutrons and radioisotopes for medical, research and industrial uses.

BACKGROUND

There are many medical, industrial, and research applications for neutrons and radioisotopes. Industrial applications include prompt gamma neutron activation analysis ("PG-NAA"), neutron radiography and radioactive gas leak testing. Medical applications include brachytherapy, radioactive medicines, radioactive stents, boron neutron capture therapy ("BNCT") and medical imaging.

Production of many useful radioisotopes requires a neutron source that provides a sufficiently high neutron flux (neutrons/cm$^2$-second), measured as the number of neutrons passing through one square centimeter of a target in 1 second. Sufficient sustained neutron flux is generally provided by nuclear reactors. Nuclear reactors are expensive to build and maintain and ill-suited for urban environments clue to safety and regulator concerns. While many useful radioisotopes are produced by nuclear reactors, only a small number of sites around the world can generate medical isotopes in clinically relevant quantities, such as Molybdenum-99 (Mo-99) one of several isotopes in high demand in the medical field. Also, the decay rate of many useful radioisotopes makes remote production of the radioisotopes impossible because the rate of decay does not provide time for processing and transport.

Non-reactor neutron sources, such as isotopes that decay by ejecting a neutron are less expensive and more convenient. However, sources such as plutonium-beryllium sources and inertial electrostatic confinement fusion devices are incapable of generating the sustained high neutron fluxes required for many applications.

Commonly used medical isotopes are created in light water reactors fueled by critical amounts of fissile material such as uranium-235. Typically, target materials are irradiated within the reactor core for a period of time, then removed and transported to heavily shielded facilities for remote chemical processing. Other reactor types have been proposed for medical isotope production, such as "aqueous homogeneous" reactor designs, also known as "fluid fuel reactors" or "solution reactors."

For example, U.S. Pat. No. 3,050,454 discloses a nuclear reactor system that flows fissile material in a stream through a reaction zone or core via a circulating flow path. U.S. Pat. No. 3,799,883 discloses a method for recovering molybdenum-99 involving irradiation of uranium material, dissolving the uranium material, precipitation of molybdenum by contact with alpha-benzoinoxime, and then contacting the solution with adsorbents. U.S. Pat. No. 3,914,373 discloses a method for isotope separation by the preferential formation of a complex of one isotope with a cyclic polyether and subsequent separation of the cyclic polyether containing the complexed isotope from the feed solution.

U.S. Pat. No. 4,158,700 discloses a purification method for producing technetium-99m in a dry, particulate form by eluting an adsorbant chromatographic material containing molybdenum-99 and technetium-99m with a neutral solvent system comprising an organic solvent containing from about 0.1 to less than about 10% water or from about 1 to less than about 70% of a solvent selected from the group consisting of aliphatic alcohols having 1-6 carbon atoms and separating the solvent system from the eluate whereby a dry, particulate residue is obtained containing technetium-99m, the residue being substantially free of molybdenum-99. U.S. Pat. No. 5,596,611 discloses a method of treating the fission products from a nuclear reactor through interaction with inorganic or organic chemicals to extract the medical isotopes. U.S. Pat. No. 5,596,611 attempts to provide a small nuclear reactor dedicated solely to the production of medical isotopes, where the small reactor is of a power level ranging from 100 to 300 kilowatt range, employs 20 liters of uranyl nitrate solution containing approximately 1000 grains of U-235 in a 93% enriched uranium or 100 liters of uranyl nitrate solution containing approximately 1000 grams of uranium enriched to 20% U-235. U.S. Pat. No. 5,910,971 discloses a method for the extraction of Mo-99 from uranyl sulphate nuclear fuel of a homogeneous solution reactor by means of a polymer sorbent.

Thus, nuclear reactors remain a key component in the production of useful isotopes. A key medical isotope is technitium-99m, which is a decay product of molybdenum-99. The half life of molybdenum-99 decay into technetium-99m is about 65 hours. Small lead generators are used to ship molybdenum-99 and technetium-99m to medical facilities, where the technetium-99m is added to various pharmaceutical test kits that are designed to test for a variety of illnesses. The four major suppliers of molybdenum-99 are Canada, the Netherlands, Belgium and South Africa. The United States uses about 150,000 doses per week to conduct body scans for cancer, heart disease and bone or kidney illnesses and cardiac stress tests.

Because reactors capable of producing technetium-99m (by producing molybdenum-99) only operate in a few countries, production of the important medical isotope depends both upon the export of Uranium and the reliable operation of reactors in other countries. Security and supply concerns are raised by the manufacture, export, and import process.

Nuclear reactor facilities have aged and can't be expected to continue reliable production, nor have new facilities been constructed. As an example, a 2007 month long shut down of Canada's NRU reactor in 2007 caused a worldwide shortage of technetium-99m/molybdenum 99). The Netherlands reactor for production of technetium-99m/molybdenum 99 experienced a long shut down in 2008. Other reactor shut downs have occurred in recent years in France. South Africa and other countries. Great benefit can be realized by eliminating the need for a nuclear reactor in the production of radioisotopes, which are typically produced in nuclear reactors because they generate the necessary sustained levels of high neutron flux. Operating reactors have aged, and new reactors have not been built. Many countries, including the United States, lack any facility for the production of medically important isotopes.

SUMMARY OF THE INVENTION

The invention provides methods for the production of radioisotopes or for the treatment of nuclear waste. In methods of the invention, a solution of heavy water and target material including fissile material is provided in a shielded irradiation vessel. Bremsstrahlung photons are introduced into the solution, and have an energy sufficient to generate photoneutrons by interacting with the nucleus of the deuterons present in the heavy water and the photoneutrons which in turn causes fission of the fissile material. The bremsstrahlung photons can be generated with an electron beam and an x-ray converter. Devices of the invention can be small and generate radioisotopes on site, such as at medical facilities and industrial facilities. Solution can be recycled for continued use after recovery of products.

DETAILED DESCRIPTION OF THE PREFERRED EMBODIMENTS

Figure 1:
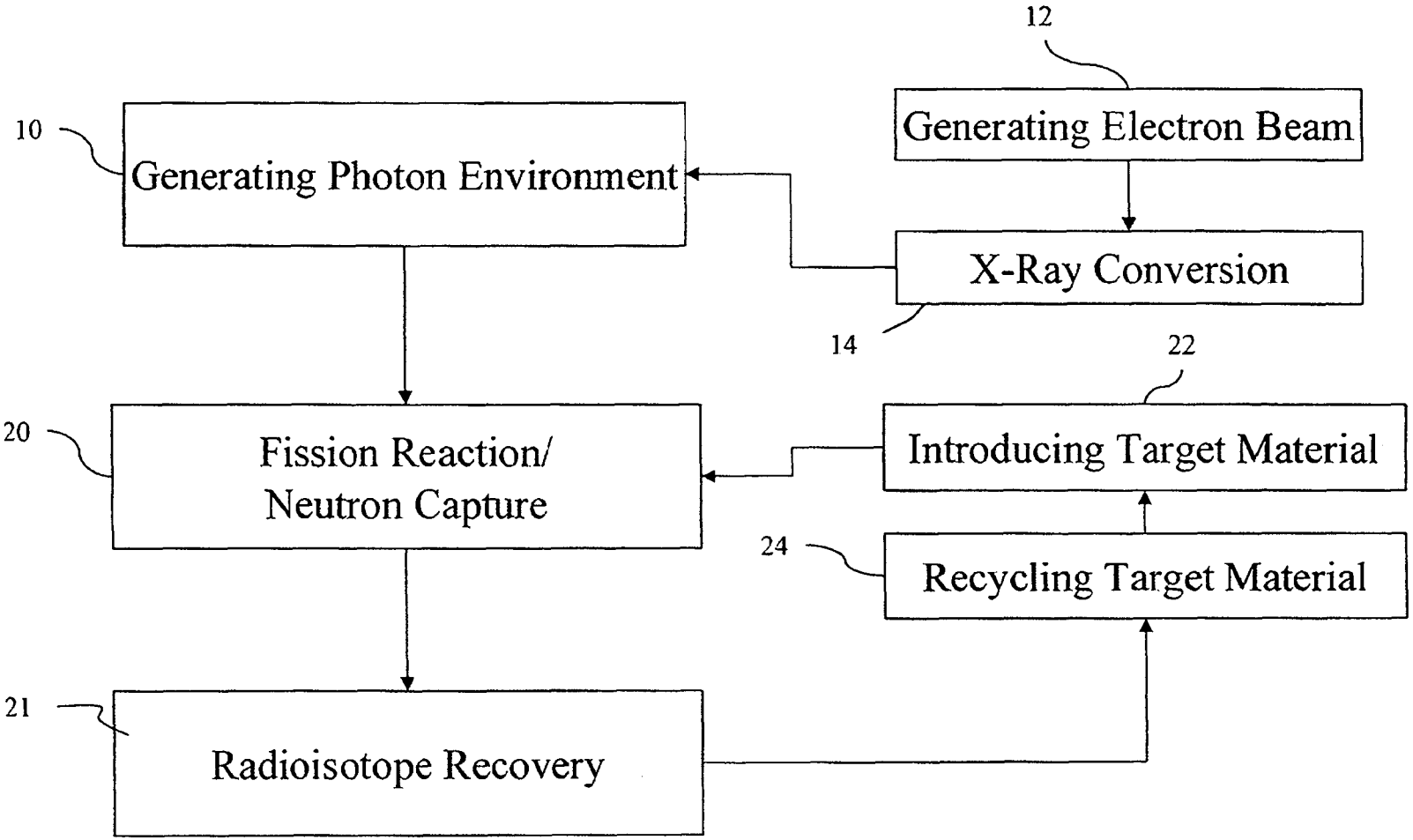
FIG. 1 is a flowchart that illustrates a preferred method of the invention.

The invention provides methods for the production of radioisotopes. In methods of the invention a solution of heavy water and fissile material is contained in a shielded irradiation vessel. Bremsstrahlung photons are injected into the solution and have an energy sufficient to cause the neutron present in the nucleus of a deuteron to be ejected from the nucleus. The resulting photoneutrons then cause fission of the fissile material. Additional material in the solution can also fission, or can undergo neutron capture. The bremsstrahlung photons can be generated with an electron beam and x-ray converter. Devices of the invention can be small and generate radioisotopes on site, such as at medical facilities and industrial facilities. The heavy water—fissile solution can be recycled for continued use after recovery of products.

The invention provides methods for the production of radioisotopes through fission of fissile material and/or neutron capture in target material. In methods of the invention a solution of heavy water (deuterium oxide) and fissile material is contained in a shielded irradiation vessel. Fissile material (typically uranium 235, uranium 233 or plutonium 239) will undergo fission when a neutron of "thermal" energy (~0.025 MeV) is captured. As fissile material is available with fissionable material (e.g., uranium 235 is available up to a 20/80 ratio of material with uranium 238 after undergoing enrichment) the solution will also include fissionable material, and some of the fissionable material will fission. Fissionable material is material that will undergo fission by capturing a neutron of "epithermal" or "fast" energies. Neutron capture material can also be included in the solution, and is material that can be converted into a useful isotope through the capture of a neutron.

In the invention, Bremsstrahlung photons are injected into the heavy water and fissile material solution and have an energy sufficient to interact with the deuterons and cause the neutron in the deuteron nuclei to be ejected. Neutrons generated by photon bombardment of deuterium nuclei are referred to as photo neutrons to differentiate them from neutrons created by the fission process, which are referred to as fission neutrons. The photoneutron field generated in the solution by the interaction of the sufficiently energetic photons and the deuterium then generate useful radioisotopes via fission of the fissile and fissionable material, and/or neutron capture by other target material.

The preferred method for generating bremsstrahlung photons is to direct an electron beam onto an x-ray converter. As a small electron accelerator can be used, devices of the invention can be small and generate radioisotopes on site, such as at medical facilities and industrial facilities. The heavy water—fissile solution can be recycled for continued use after recovery of products.

Preferred methods and systems of the invention generate radioisotopes from the fission of target material in subcritical amounts via bombardment with photoneutrons (for example, production of molybdenum-99 as a fission product of uranium-235) or through the capture of photoneutrons by other target material included in the fissile-heavy water solution (such as production of yttrium-90 via neutron capture by yttrium-89). Methods of the invention can be carried out without a nuclear reactor, and preferred systems of the invention make use of an electron beam that permits a compact system that can be used on site to generate radioisotopes.

Preferred methods and systems of the invention convert an electron beam to bremsstrahlung photons via an x-ray converter and introduce the bremsstrahlung photons into heavy water that includes a subcritical amount of fissile material in a shielded irradiation vessel. The bremsstrahlung photons have sufficient energy to dissociate a neutron from a deuteron ($^2H$) to create photoneutrons. The heavy water both contains the target material and moderates the photoneutron to thermal energies.

The invention also provides methods and systems for the treatment of nuclear waste. Used nuclear fuels or other nuclear wastes can be introduced into heavy water and fissile material solution to create the solution of target material and heavy water. Photoneutrons of sufficient energy are generated in the system to cause neutron capture or fission by the target material, allowing for this waste to be converted to more manageable or stable isotopes.

To produce a radioisotope that is a fission product, appropriate fissile or fissionable material is included in the solution as additional target material. The bombardment of the target material with photoneutrons then causes a fission reaction of the target material leading to the production of a useful radioisotope as a fission product. To produce a radioisotope that is not a fission product, appropriate material that can capture neutrons to create a radioisotope is included in the solution as additional target material. Thus, methods and systems of the invention can be used to produce radioisotopes that are fission products and radioisotopes that are not available as fission products, e.g. samarium-153 or phosphorus-33.

In preferred embodiment methods and systems of the invention, the electron beam has an energy ranging from about 5 to 30 MeV, and most preferably from about 5 to about 15 MeV. In preferred methods and systems of the invention, x-ray convertor material has an atomic number of at least 26, and most preferably at least 71.

In preferred embodiments of the invention, radioisotope products are recovered from the irradiation vessel by filtration of the heavy water solution or by interaction with a solvent. The solution with remaining target material can be recycled to perform again as a moderator and medium to contain target material. Recycling can include chemical treatment to adjust pH and addition of heavy water or additional target material.

In preferred systems of the invention, the irradiation vessel can be removable from the system, and in other systems of the invention, inlets and outlets can circulate heavy water and target material in and out of the irradiation vessel. A removable irradiation vessel can be moved to a process station to extract the solution of heavy water, radioisotopes and remaining target material for processing. A circulation system can also direct solution to a process station in the case of a fixed irradiation vessel. Systems of the invention can also include a sample station to place target material separate from the heavy water to be irradiated by photoneutrons and fission neutrons in the container.

Preferred embodiments of the invention will now be discussed with respect to the drawings. The drawings may include schematic representations, which will be understood by artisans in view of the general knowledge in the art and the description that follows. Features may be exaggerated in the drawings for emphasis, and features may not be to scale. Unless otherwise defined, all technical and scientific terms used herein have the same meaning as commonly understood by one of ordinary skill in the art to which this invention belongs.

FIG. 1 illustrates a preferred method of the invention for producing radioisotopes or for treating nuclear waste. In the method of FIG. 1, a photon environment is created (step 10). The preferred steps for creating photons for the photon environment are creating an electron beam (step 12) and directing the beam onto an x-ray converter (step 12). The photon environment 10 is within an irradiation vessel that contains heavy water and a target material. Bremsstrahlung photons are directed from the x-ray converter into the heavy water within the shielded irradiation vessel that includes a subcritical amount of fissile material, and can also include additional fissionable or neutron capture target material. The photons cause photoneutrons to be ejected from the deuterium present in the heavy water. The heavy water moderates the photoneutrons to thermal energies. The heavy water both contains the target material and moderates the photoneutrons to lower energies which allow for higher rates of fission or neutron capture by the target material.

The target material undergoes a fission reaction or neutron capture (step 20). To produce a radioisotope that is a fission product, appropriate fissile or fissionable material is selected as the target material. The bombardment of the target material then causes a fission reaction of the target material leading to a useful radioisotope as fission product. To produce a radioisotope that is not a fission product, additional material that can capture neutrons to create a radioisotope is included in the solution as additional target material. Thus, methods and systems of the invention can be used to produce radioisotopes that are fission products and radioisotopes that are not available as fission products. The additional target material can be nuclear waste in a preferred method for treatment of nuclear waste and undergo fission or neutron capture to convert the nuclear waste to a more acceptable or manageable isotope.

Produced radioisotopes are recovered (Step 21). The recovery can be conducted by filtration of the heavy water solution. A subcritical amount of fissile material is utilized in the photon environment.

The solution of heavy water, fissile material and any additional target material can be introduced (Step 22) with use of a circulation system or with an irradiation vessel that is removable. A removable irradiation vessel can be moved to a process station to extract the solution of heavy water, radioisotopes and remaining target material for processing. A circulation system can also direct solution to a process station in the case of a fixed irradiation vessel. The solution can be recycled (Step 24) such as by chemical treatment to set a pH level and the addition of heavy water and/or target material. The recycling (Step 24) is conducted after the step of recovering (Step 21) and is readily accomplished with either a circulation system or a removable irradiation vessel.

Figure 2:
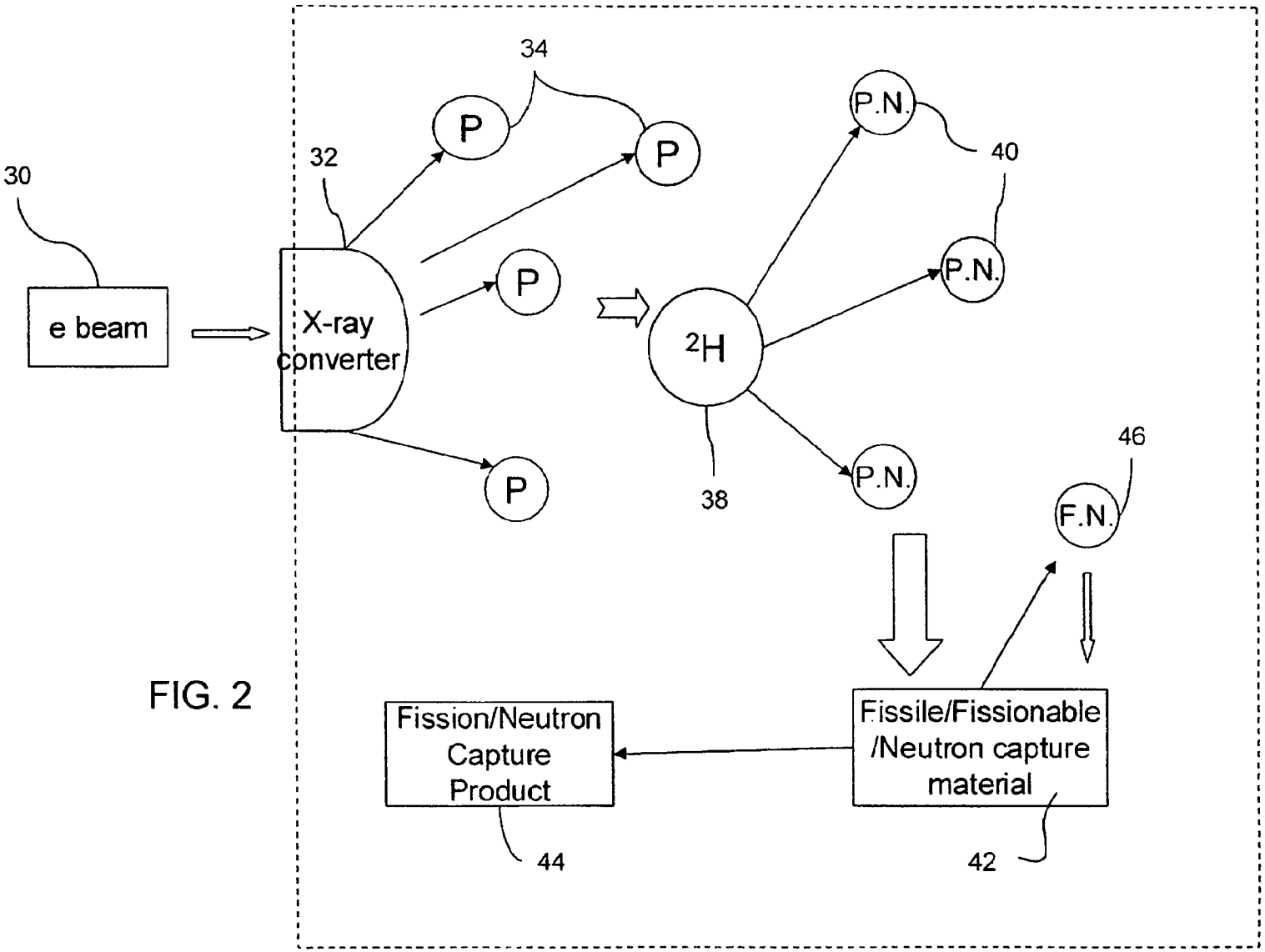
FIG. 2 schematically illustrates events that happen in a preferred device of the invention carrying out a method of the invention.

FIG. 2 schematically illustrates events that occur in a preferred device of the invention. An electron beam 30, preferably having an energy ranging from about 5 to 30 MeV, and most preferably from about 5 to 10 MeV, is incident on an x-ray converter 32 (such as tantalum or tungsten) to produce bremsstrahlung photons 34. The bremsstrahlung photons 34 are directed into an irradiation vessel 36 that contains heavy water 38, which provides a source of $^{2}H$. Neutrons 40 (referred to as photoneutrons as they originate through the interaction of a deuteron nucleus with a photon), are produced through a photonuclear reaction. A photonuclear reaction occurs when a photon has sufficient energy to overcome the binding energy of the neutron in the nucleus of an atom, where a photon is absorbed by a nucleus and a neutron is emitted. The deuterium $^{2}H$ has a photonuclear threshold energy of 2.23 MeV. The bremsstrahlung photons have sufficient energy to cause a photonuclear reaction in heavy water.

The neutrons 40 are then captured by target material 42, which can trigger a fission reaction of the target material when the target material is fissile or fissionable. During the fission reaction, desired radioisotopes are produced as fission products 44 along with fission neutrons 46. The continuous production of photoneutrons by the photonuclear reaction of heavy water through application of the electron beam 30 to the x-ray converter 32 sustains the fission reaction. While the fission neutrons 46 are also "injected" back to the irradiation vessel and sustain to a certain extent the fission reaction, the fission neutrons alone can not sustain the fission reaction so long as a subcritical amount of target material is used. As discussed previously, target material can also be selected to produce radioisotopes via neutron capture.

Figure 3:
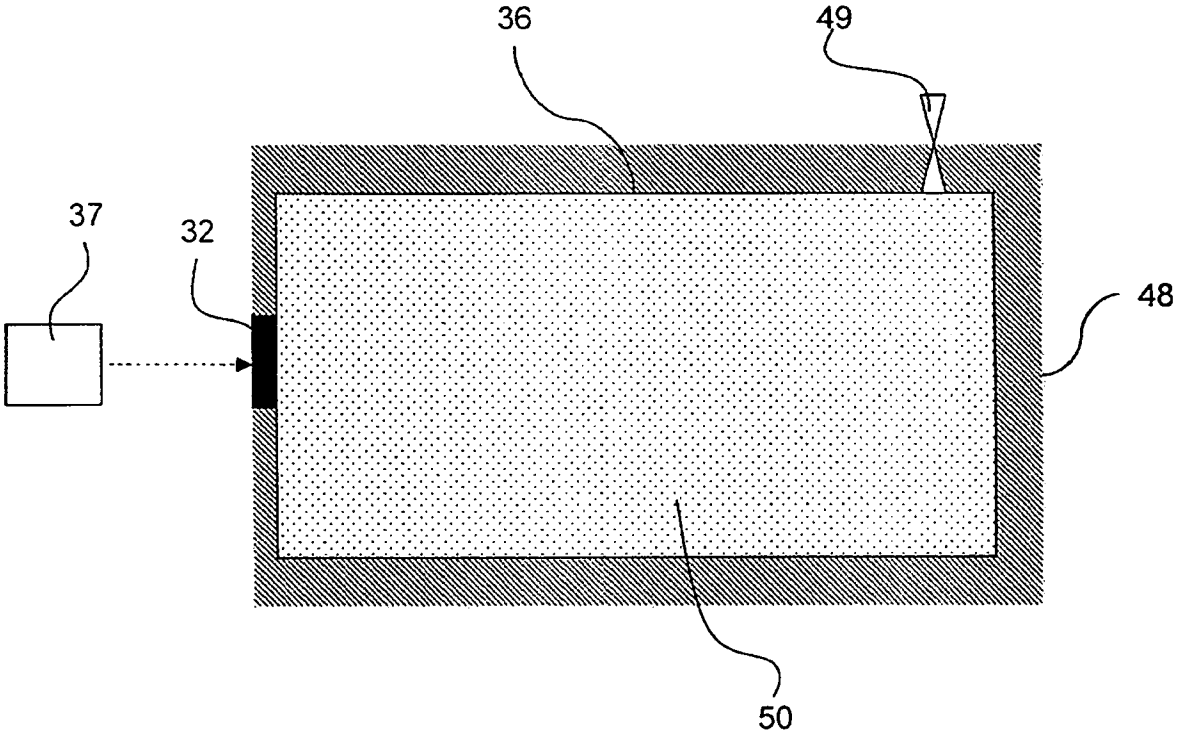
FIG. 3 is a schematic cross-section of an irradiation vessel used in a preferred device of the invention.

FIG. 3 shows a cross-section of the irradiation vessel 36 and x-ray converter 32. The x-ray converter 32 receives an electron beam from an electron beam generator 37. A proton beam generator can also be used with an appropriate photon-producing material, but a proton beam and photon-producing material are not as efficient at generating photons. The irradiation vessel 36 is shielded with reflector material 48, which preferably completely surrounds the irradiation vessel 36. A plenum 49 captures gasses released as fission products or due to radiolysis. The irradiation vessel 36 is constructed of material that is resistant to radiation damage and corrosion, such as, but not limited to, various alloys of zirconium or some stainless steels. The reflector 48 is constructed of or contains material that efficiently reflects neutrons back into the irradiation vessel 36, such as, but not limited to, light water, heavy water, beryllium, nickel, or low-density polyethylene. As discussed above, heavy water 50 that contains target material within the irradiation vessel 36 serves both as a source of photoneutrons and as a moderator of photoneutrons and fission neutrons. The irradiation vessel 36 can include or be attached to a mixer or agitator to maintain the solution of heavy water and target material and to inhibit sedimentation of the target material.

Figure 4:
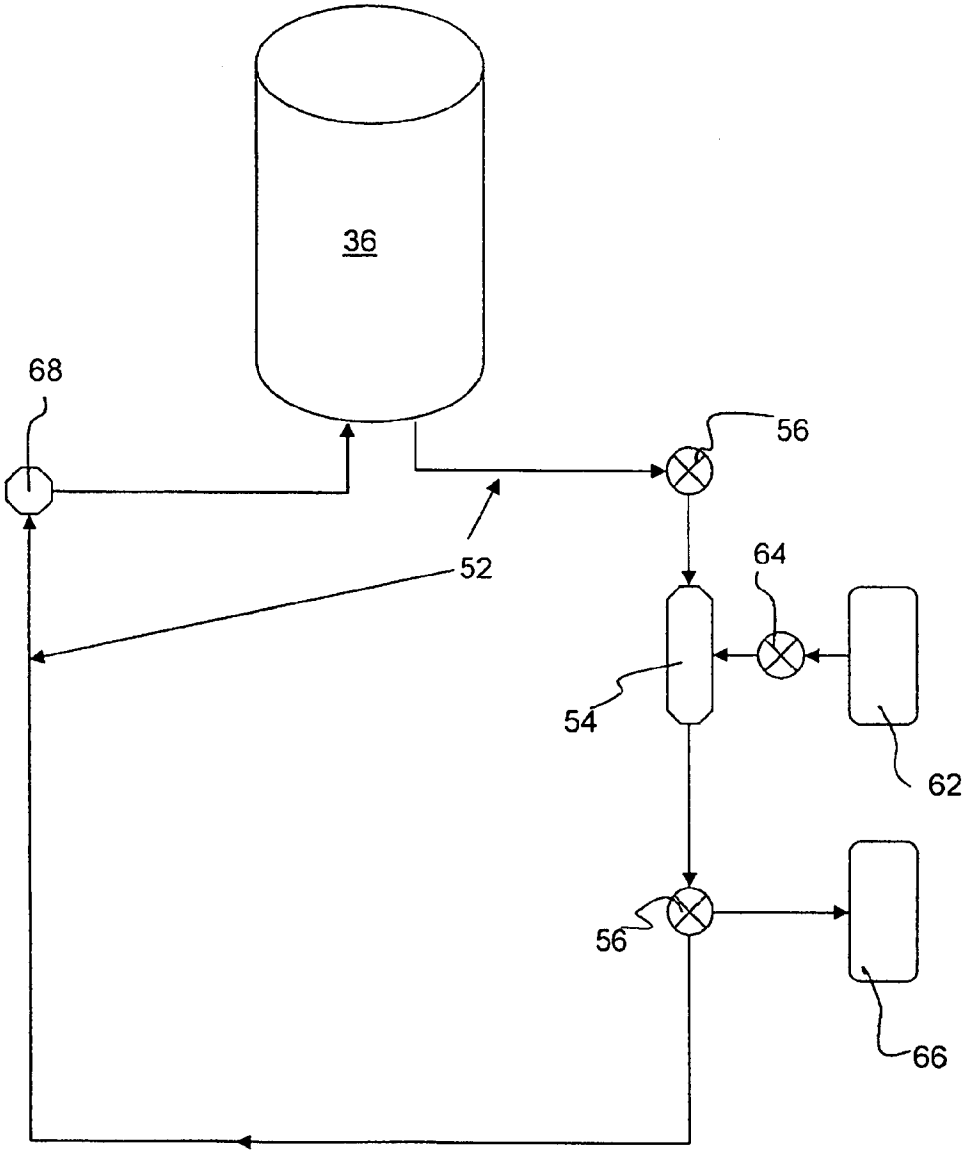
FIG. 4 is a schematic diagram of a preferred embodiment system of the invention.

FIG. 4 illustrates a system for production and extraction of radioisotopes. A circulation loop 52 formed from suitable piping, which should be shielded, defines a loop for the insertion and removal of solution from the irradiation vessel 36. After radioisotope production, solution with its radioisotope product is diverted into a radioisotope recovery station 54 via a valve 56. A sorbent column or filtration system in the station 54 collects the radioisotopes and the solution re-enters the circulation loop 52 via the valve 56.

Typically, recovery of the radioisotope at the recovery station can be accomplished after about 12 to 36 hours of filtration or interaction of the solution with the sorbent. A washing and elution station 62 then washes a chemical, such as water, over the sorbent columns or filtration system via a valve 64 to wash elutant carrying purified radioisotopes to an extraction station, thereby rinsing the sorbent 66. Further isotopes of interest may be processed into the radioisotope extraction station where chemical processing suited to the radioisotope of interest is performed. The remaining solution from which radioisotopes have been collected is sent to a recycling station 68 via the circulation loop 52. Recycling can involve chemical treatment, addition of heavy water, and addition of target material. In addition, light water can be introduced into the solution as needed to aid in either chemical processing or to alter the neutronics of the system.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. A method for the production of a radioisotope or for the treatment of nuclear waste, the method comprising steps of:

providing a solution of heavy water and target material in a shielded irradiation vessel, wherein the target material includes fissile material;

generating an electron beam;

directing the electron beam onto an x-ray converter to generate bremsstrahlung photons; and introducing the bremsstrahlung photons into the solution, wherein the bremsstrahlung photons have energy sufficient to generate photoneutrons by interacting with nuclei of deuterons present in the heavy water and the photoneutrons to cause fission of the fissile material.

2. The method of claim 1, further comprising a step of producing yttrium-90 via neutron capture of yttrium-89 in the solution.

3. The method of claim 1, wherein the electron beam has an energy within the range of about 5 to 30 MeV.

4. The method of claim 3, wherein the electron beam has an energy within the range of about 5 to about 15 MeV.

5. The method of claim 1, wherein the x-ray converter has an atomic number of at least 26.

6. The method of claim 5, wherein the x-ray converter has an atomic number of at least 71.

7. The method of claim 1, wherein the solution includes a sub-critical amount of fissile material.

8. The method of claim 7, wherein the solution includes neutron capture material as additional target material.

9. The method of claim 7, wherein the fissile material comprises uranium-235.

10. The method of claim 9, further comprising a step of recovering molybdenum-99 as a fission product of the uranium-235.

11. The method of claim 7, wherein the fissile material comprises uranium-233.

12. The method of claim 7, wherein the fissile material comprises plutonium-239.

13. The method of claim 1, further comprising recovering the radioisotope from the solution.

14. The method of claim 13, wherein said step of recovering comprises filtering.

15. The method of claim 13, wherein said step of recovering comprises interacting the solution with sorbent.

16. The method of claim 15, further comprising rinsing the sorbent.

17. The method of claim 13, further comprising recycling the solution.

18. The method of claim 17, wherein said step of recycling comprises treating the solution with chemicals, adding heavy water, and adding target material.

19. A method for the production of a radioisotope or for the treatment of nuclear waste, the method comprising steps of:

providing a solution of heavy water and target material in a shielded irradiation vessel, wherein the target material includes fissile material and fissionable material;

generating an electron beam;

directing the electron beam onto an x-ray converter to generate bremsstrahlung photons; and introducing the bremsstrahlung photons into the solution, wherein the bremsstrahlung photons have energy sufficient to generate photoneutrons by interacting with nuclei of deuterons present in the heavy water and the photoneutrons to cause fission of the fissile material.

20. A device for production of a radioisotope or for the treatment of nuclear waste, the device comprising:

an electron beam generator configured to generate an electron beam having an energy in the range of about 5 MeV to 30 MeV;

an x-ray converter configured to receive an electron beam from said electron beam generator;

a shielded irradiation vessel configured to receive bremsstrahlung photons from said x-ray converter and containing a solution of heavy water and fissile material.

* * * * *

UNITED STATES PATENT AND TRADEMARK OFFICE

CERTIFICATE OF CORRECTION

PATENT NO. : 8,644,442 B2
APPLICATION NO. : 12/364942
DATED : February 4, 2014
INVENTOR(S) : John M. Gahl et al.

It is certified that error appears in the above-identified patent and that said Letters Patent is hereby corrected as shown below:

On the Title Page:

Item (56) References Cited

Page 2, Left Column, line 37,
"Foreign Patent Documents" Please delete "11/2012" and insert --11/2002-- therefor.

Page 2, Right Column, line 38,
"Other Publications" Please delete "Ratcliff" and insert --Ratcliffe-- therefor.

In the Specification:

Col. 1, line 34 Please delete "clue" and insert --due-- therefor.

Col. 2, line 21 Please delete "grains" and insert --grams-- therefor.

Col. 2, line 51 After "molybdenum 99", please delete ")".

Col. 2, line 54 After "France", please delete "." and insert --,-- therefor.

Col. 7, line 5 Before "66", please delete ", thereby rising the sorbent".

Signed and Sealed this
Twenty-third Day of September, 2014

Michelle K. Lee

Michelle K. Lee
*Deputy Director of the United States Patent and Trademark Office*